US011560293B2

(12) United States Patent
Mathe

(10) Patent No.: US 11,560,293 B2
(45) Date of Patent: Jan. 24, 2023

(54) TOWER CRANE WITH A DETECTION OF A ROTATING PART AUTOROTATION OR OSCILLATION STATE IN AN OUT OF SERVICE CONFIGURATION

(71) Applicant: MANITOWOC CRANE GROUP FRANCE, Dardilly (FR)

(72) Inventor: Denis Mathe, Tassin-la-Demi-Lune (FR)

(73) Assignee: Manitowoc Crane Group France, Dardilly (FR)

( * ) Notice: Subject to any disclaimer, the term of this patent is extended or adjusted under 35 U.S.C. 154(b) by 53 days.

(21) Appl. No.: 17/369,919

(22) Filed: Jul. 7, 2021

(65) Prior Publication Data

US 2022/0009754 A1 Jan. 13, 2022

(30) Foreign Application Priority Data

Jul. 7, 2020 (FR) ..... 2007163

(51) Int. Cl.
*B66C 23/90* (2006.01)
*B66C 13/00* (2006.01)
(Continued)

(52) U.S. Cl.
CPC ..... *B66C 23/905* (2013.01); *B66C 13/00* (2013.01); *B66C 13/22* (2013.01); *B66C 23/94* (2013.01);
(Continued)

(58) Field of Classification Search
CPC ..... B66C 23/022; B66C 23/16; B66C 23/163; B66C 23/84; B66C 23/88; B66C 23/94;
(Continued)

(56) References Cited

U.S. PATENT DOCUMENTS 9,327,950 B2 * 5/2016 Mayer ..... B66D 5/04
10,633,228 B2 * 4/2020 Münst ..... B66C 23/94
(Continued)

FOREIGN PATENT DOCUMENTS

CA 2790152 C * 6/2015 ..... B66C 23/84
FR 2931466 A1 11/2009
(Continued)

OTHER PUBLICATIONS

WO 2020/094770 A1 Machine Translation (Year: 2020).*
(Continued)

*Primary Examiner* — Michael R Mansen
*Assistant Examiner* — Juan J Campos, Jr.
(74) *Attorney, Agent, or Firm* — Cook Alex Ltd.

(57) ABSTRACT

A tower crane includes a tower on which a rotating portion is pivotally mounted and configurable between a service configuration in which the rotating portion can be rotatably driven by a motorized orientation system, and an out of service configuration in which the rotating portion is rotatably released to be able to be oriented in the direction of the wind. A control/command unit activates a monitoring mode in the out of service configuration to detect, depending on variations in the angle of orientation or the angular speed of the rotating portion, if the rotating portion is in one of the following movement states: an autorotation state corresponding to a rotary movement of the rotating portion in a given direction over at least one complete turn; or an oscillation state corresponding to a back and forth movement of the rotating portion about the orientation axis.

17 Claims, 2 Drawing Sheets

(51) Int. Cl.

| | |
|---|---|
| ***B66C 13/22*** | (2006.01) |
| ***B66C 23/94*** | (2006.01) |
| *B66C 23/02* | (2006.01) |
| *B66C 23/84* | (2006.01) |

(52) U.S. Cl.
CPC ..... *B66C 23/022* (2013.01); *B66C 23/84* (2013.01); *B66C 2700/0385* (2013.01); *B66C 2700/0392* (2013.01); *B66C 2700/082* (2013.01); *B66C 2700/084* (2013.01)

(58) Field of Classification Search
CPC ..... B66C 13/22; B66C 13/30; B66C 23/62; B66C 23/64; B66C 2700/0392; B66C 2700/082; B66C 2700/084; B66C 23/905; B66C 13/00; B66C 15/065

See application file for complete search history.

(56) References Cited

U.S. PATENT DOCUMENTS

| | | | | |
|---|---|---|---|---|
| 2010/0006530 | A1* | 1/2010 | Juraszek | B66C 23/04 212/272 |
| 2014/0083965 | A1* | 3/2014 | Mayer | B66D 5/026 212/223 |
| 2016/0362283 | A1* | 12/2016 | Münst | B66C 23/16 |

FOREIGN PATENT DOCUMENTS

| | | | | |
|---|---|---|---|---|
| JP | H08324965 | A | 12/1996 | |
| WO | WO-2017133841 | A1 * | 8/2017 | B66C 13/48 |
| WO | WO-2020094770 | A1 * | 5/2020 | B66C 23/022 |

OTHER PUBLICATIONS

WO 2017/133841 A1 Machine Translation (Year: 2017).*
Search Report and Written Opinion issued by French Patent Office (INPI) in corresponding FR Pat. Appl. 20/07163, dated Mar. 26, 2021.

* cited by examiner

TOWER CRANE WITH A DETECTION OF A ROTATING PART AUTOROTATION OR OSCILLATION STATE IN AN OUT OF SERVICE CONFIGURATION

FIELD

The following description relates to a tower crane as well as a method for monitoring a tower crane.

The description applies to the field of tower cranes comprising a rotating portion, and can be applied to several crane structures, for example to structures composed of trusses and chords.

BACKGROUND

Conventionally, a tower crane comprises a tower on which a rotating portion is pivotally mounted along an orientation axis, generally vertical, by means of a pivoting mechanism, also called a rotating pivot, which includes at least one motorized orientation system (often of the geared motor type) and a mechanical orientation brake. The rotating portion generally comprises a distributor boom and, depending on the model, a counter-boom, a boom holder and/or a pilot cabin.

Moreover, such a tower crane can be configured between:

- a service configuration in which the rotating portion is rotatably driven on the tower along the orientation axis (also called orientation control) by means of the motorized orientation system, to displace a load by means of a lifting system carried by the boom of the rotating portion; and
- an out of service configuration (also called safety or weather vane configuration) in which the rotating portion is rotatably released on the tower along the orientation axis, the mechanical orientation brake then being deactivated, in order to be able to be oriented in the direction of the wind, the rotating portion is then free to rotate around the orientation axis and it is conventional to say that the rotating portion is turned into a weather vane.

In the event of strong winds, it is recommended to secure the tower crane (also called weather vane of the rotating portion), by disengaging the rotating portion (in other words by releasing the rotatably rotating portion on the tower, by unblocking the mechanical orientation brake and by disengaging the motorized orientation system) so that it is free to rotate in order to be automatically oriented in the direction of the wind and thus allow the crane to be left unattended.

However, in particular windy conditions, usually due to the site environment such as the presence of nearby buildings, the rotating portion of the crane can enter movement states, including:

- an autorotation state characterized by the completion of a full turn or a succession of complete turns about the orientation axis at an angular speed greater than a given threshold (in other words the rotating portion makes one or more turns on itself at a too high speed); and
- an oscillation state characterized by a cycle or a succession of cycles back and forth about the orientation axis at an angular speed greater than a given threshold (in other words the rotating portion pivots from right to left at a too high speed).

Simulations, for example in a wind tunnel or in numerical modeling, make it possible to study the windy conditions of a site and thus to anticipate such movements, to provide preventive solutions upstream, such as for example the selection of a taller crane or provided with a more massive structure. It is indeed desired to reduce such movements, because an autorotation or oscillation state can lead to damage to the rotating portion or of the crane.

SUMMARY

The present disclosure proposes to respond at least in part to the aforementioned drawbacks, by proposing to detect in situ and in real time if a rotating portion is in a movement state.

Thus, the present disclosure provides a tower crane comprising a tower on which is pivotally mounted a rotating portion along an orientation axis by means of a pivot mechanism, this pivot mechanism including at least one motorized orientation system, a mechanical orientation brake and an angular detector capable of detecting an orientation angle of the rotating portion, this tower crane being configurable between:

- a service configuration in which the rotating portion can be rotatably controlled on the tower along the orientation axis by means of the motorized orientation system, and
- an out of service configuration in which the rotating portion is rotatably released on the tower along the orientation axis to be able to be oriented in the direction of the wind, the mechanical orientation brake being deactivated in the out of service configuration.

According to the embodiments herein, the tower crane comprises a control/command unit connected to the motorized orientation system, to the mechanical orientation brake and to the angular detector, and in the out of service configuration, the control/command unit activates a monitoring mode in which the control/command unit detects, as a function of variations in the angle of orientation of the rotating portion or as a function of variations of an angular speed of the rotating portion established from the variations of the angle of orientation, if the rotating portion is in one of the following movement states:

- an autorotation state, corresponding to a rotary movement of the rotating portion in a given direction over at least one complete turn, characterized by a variation of the orientation angle according to an angular amplitude at least greater than an angular autorotation threshold of at least 360 degrees in a first given time interval or at an angular speed greater than a given autorotation speed threshold; or
- an oscillation state, corresponding to a back and forth movement of the rotating portion about the orientation axis, characterized by at least one cycle of variations of the orientation angle in a first direction then in a second direction, opposite to the first direction, characterized by an angular displacement of the orientation angle at least equal to an angular oscillation threshold comprised between 20 and 180 degrees in a second given time interval or at an angular speed greater than a given oscillation speed threshold.

Thus, the control/command unit uses the angle detector to detect one or the other of the following two movement states: the autorotation state and the oscillation state. By following the variations in the orientation angle, the control/command unit can indeed determine the direction and the angular speed of the rotating portion in real time. On the basis of these measurements, the control/command unit can compare the variations in the orientation angle with one or more thresholds, and deduce the autorotation or oscillation states.

Regarding the autorotation state, the latter will be characterized by a detection of a rotary movement in one direction, with an angular amplitude of at least greater than 360 degrees (namely at least one turn) over a first given time interval or at an angular speed greater than an autorotation speed threshold. Concerning the oscillation state, the latter will be characterized by a detection of a back and forth movement (which corresponds to a succession of variations of the orientation angle in one direction then in the other, in other words a succession of back and forth), with an angular displacement (or maximum angular deviation traveled in the back and forth movement) over a second given time interval or at an angular speed greater than an oscillation speed threshold.

In one embodiment, in the service configuration, the control/command unit deactivates the monitoring mode.

In one embodiment, the crane comprises at least one anemometer suitable for measuring a wind speed and connected to the control/command unit and, in the monitoring mode, the control/command unit detects a movement state also depending on the wind speed.

Thus, the autorotation state and the oscillation state are also characterized by the wind speed, and for example by whether or not a wind speed threshold is exceeded.

Advantageously, in the monitoring mode, if a movement state is detected, then the control/command unit records a movement event defined by a recording of a date (day and hour) of the movement state and one or more movement parameters selected from:

- variations in the angle of orientation;
- angular speeds or at least a maximum angular speed during the movement state;
- the angular amplitude for an autorotation state; and
- the angular displacement for an oscillation state.

The recording of movement events (which is equivalent to a fault type event in the crane) allows a historization of the movements encountered by a crane on a given site.

The characteristics representative of the movement states (angular amplitude, angular autorotation threshold, first time interval, angular deflection, oscillation angular threshold, second time interval and, if applicable, autorotation speed threshold and oscillation speed threshold) can be selected to correspond to low movement states for the crane (in other words, movement states in which movements or characteristics are within an acceptable range), so that the movement events recording constitutes a pre-alarm or a preventive act, announcing a potential risk for the crane, on this site.

In fact, low wind speeds are much more frequent, so that the detection of movement states and the recording of movement events can reliably detect low-risk oscillations and autorotations in light winds by recording their frequency and amplitude, which makes it possible to factually detect the presence of a potentially undesirable phenomenon at higher wind speeds. The user informed by the movement events recording can then take any measures to secure the crane (such as, for example, adding wind plates, adding a mechanical orientation brake, adding weight or ballast, raising the crane or even replacing the crane), and avoid high movement states for high and rare wind speeds.

According to another possibility, in the monitoring mode, if a movement state is detected, then the control/command unit registers in the movement event also variations of the wind speed or an average wind speed or maximum wind speed during the movement state.

In this way, the recorded movement event also integrates information on the wind speed, which will make it possible to estimate a theoretical behavior of the crane in the event of a higher wind speed, and therefore allow taking corrective measurements.

Indeed, a movement state can occur at any wind speed, with an observed preponderance, either for a low wind speed in a very stable laminar wind condition, a situation which can cause damage to the mechanical portion of the crane but rarely present movement risks, or for a high wind speed such as storm, which may be more likely to cause high movement states of the crane. It is therefore advantageous to record the wind speed for each detected movement state, therefore in each recorded movement event.

According to another possibility, the control/command unit triggers a transmission to a third party of a preventive message containing the movement event.

In other words, the recorded movement event is communicated to a remote third party, to inform it of movement states and therefore of the movement dates and parameters.

In one embodiment, in the monitoring mode, the control/command unit detects whether the movement state corresponds to one of the following high movement states:

- an autorotation state in which the angular amplitude is greater than a high angular autorotation threshold in the first given time interval, said high angular autorotation threshold being greater than the angular autorotation threshold;
- an autorotation state in which the angular speed is greater than a high autorotation speed threshold, said high autorotation speed threshold being greater than the autorotation speed threshold; and when such a high movement state is detected, then the control/command unit triggers at least one alert action.

Thus, if the angular amplitude is greater than this high angular autorotation threshold (itself greater than the angular autorotation threshold which characterizes an autorotation state) or if the angular speed is greater than a high autorotation speed threshold (itself greater than the autorotation speed threshold which also characterizes an autorotation state), then this autorotation state is considered to be a high movement state and therefore as requiring an alert, to stop or reduce this high movement state.

Advantageously, another high movement state corresponds to an autorotation state in which the angular speed is between the autorotation speed threshold and the high autorotation speed threshold, and the wind speed is greater than one high wind speed threshold.

In other words, a high autorotation state can be characterized by a high angular speed (that is to say greater than the high autorotation speed threshold) and this whatever the wind speed, or else be characterized by a low angular speed (that is to say between the autorotation speed threshold and the high autorotation speed threshold) but in association with a high wind speed (that is to say greater than the high wind speed threshold).

In one embodiment, the high wind speed threshold is between 10 and 20 m/s, and for example between 14 and 20 m/s.

According to a characteristic, the alert action comprises an activation of a sound or light local alarm.

In this way, the neighboring person (s) are alerted to a movement of the crane, and can therefore take appropriate measures, such as by moving away or intervening on the crane.

According to another characteristic, the alert action comprises sending an alarm message to a remote entity.

Thus, a manager or site manager, a crane operator, a crane owner, or other person, can be informed of a crane movement, without being on site. Such an alarm message can be sent by radiocommunication or wireless communication, for example in the form of a message on a dedicated interface or application, of an e-mail on one or more registered e-mail addresses, or of a text message to one or more registered telephone numbers.

According to a possibility, the alert action comprises sending a warning message to a third party advising of a detection of a high movement condition.

This warning message can be sent to a competent authority or to a site manager to notify them that a movement condition has been detected, and that therefore the site may present a risk.

According to another possibility, the alert action comprises an activation of the mechanical orientation brake.

In this way, the activation of the mechanical orientation brake will make it possible to slow down the movements of the rotating portion to bring rotation speeds below the characteristic thresholds of autorotation and oscillation states.

In a particular embodiment, the alert action comprises an activation of the motorized steering system to generate a braking torque opposed to the rotation of the rotating portion.

In such an embodiment, the braking of the rotating portion is operated by a braking torque generated by the motorized orientation system, to bring the rotating portion back to a state with rotation speeds below the characteristic thresholds of the autorotation and oscillation states.

The present description also relates to a method for monitoring a tower crane as described above, that is to say which comprises a tower on which a rotating portion is pivotally mounted along an orientation axis by means of a pivoting mechanism, this pivoting mechanism including at least one motorized orientation system, a mechanical orientation brake and an angular detector capable of detecting an orientation angle of the rotating portion, the tower crane being configurable between a service configuration in which the rotating portion can be rotatably driven on the tower along the orientation axis by means of the motorized orientation system, and an out of service configuration in which the rotating portion is rotatably released on the tower according to the orientation axis to be able to be oriented in the direction of the wind, the mechanical orientation brake being deactivated in the out of service configuration, and in which is provided a control/command unit connected to the motorized orientation system and to the angle detector.

According to an embodiment, this monitoring method comprises, in the out of service configuration, a step of activating a monitoring mode in which the control/command unit detects, as a function of variations in the orientation angle of the rotating portion or as a function of variations of an angular speed of the rotating portion established from the variations of the angle of orientation, if the rotating portion is in one of the following movement states:

- in an autorotation state, corresponding to a rotary movement of the rotating portion in a given direction over at least one complete turn, characterized by a variation of the orientation angle according to an angular amplitude at least greater than an angular autorotation threshold of at least 360 degrees in a first given time interval or at an angular speed greater than a given autorotation speed threshold; or
- in an oscillation state, corresponding to a back and forth movement of the rotating portion around the orientation axis, characterized by at least one cycle of variations of the orientation angle in a first direction then in a second direction, opposite to the first direction, characterized by an angular displacement of the orientation angle at least equal to an angular oscillation threshold comprised between 20 and 180 degrees in a second given time interval or to an angular speed greater than a given oscillation speed threshold.

According to a possibility, the monitoring method comprises, in the service configuration, a step of deactivating the monitoring mode.

BRIEF DESCRIPTION OF THE DRAWINGS

Other characteristics and advantages of the present invention will become apparent on reading the detailed description below, of a non-limiting example of implementation, made with reference to the appended figures in which.

DESCRIPTION

Figure 1:
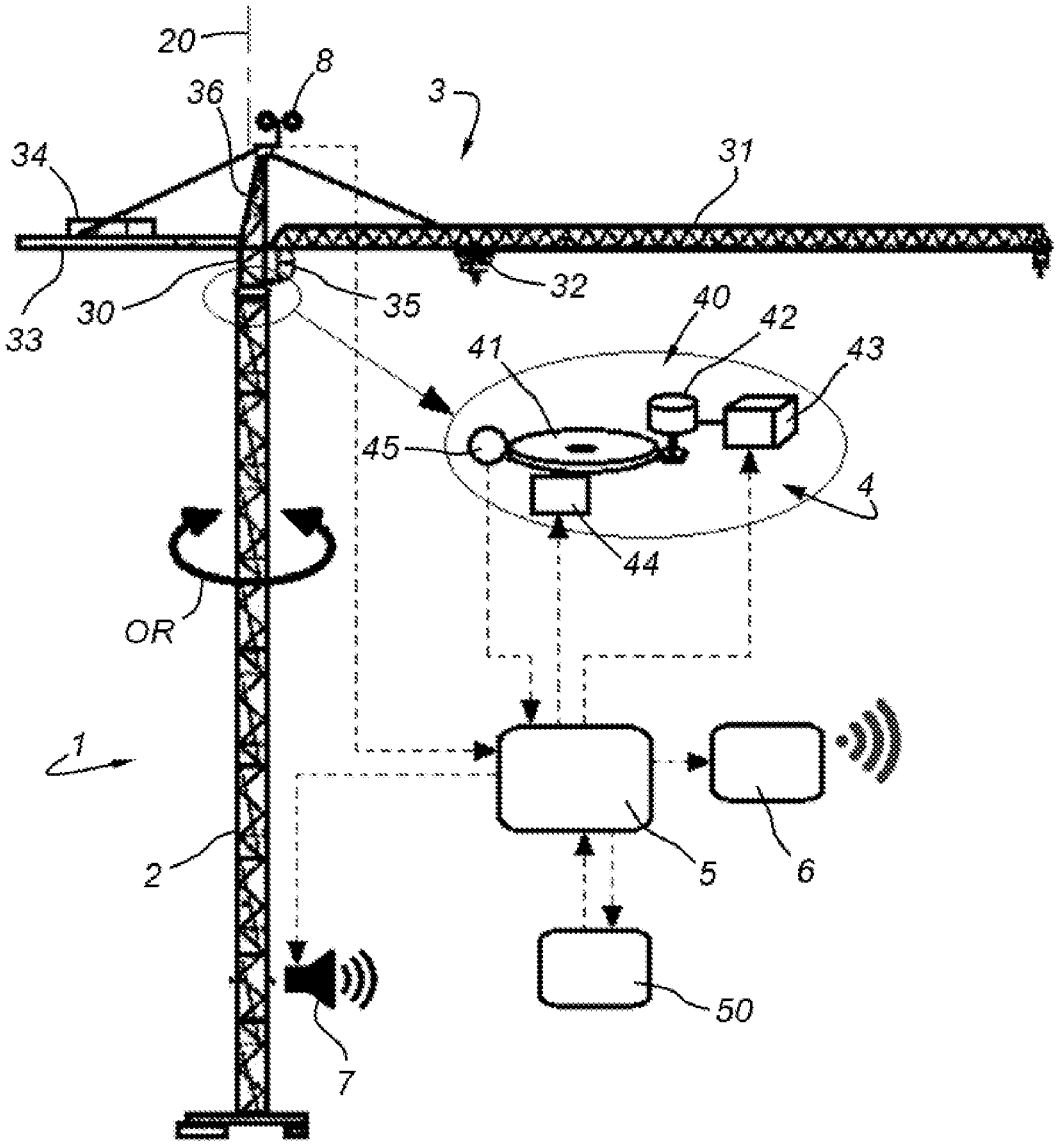
FIG. 1 is a schematic side view of a tower crane according to an embodiment.
Figure 2:
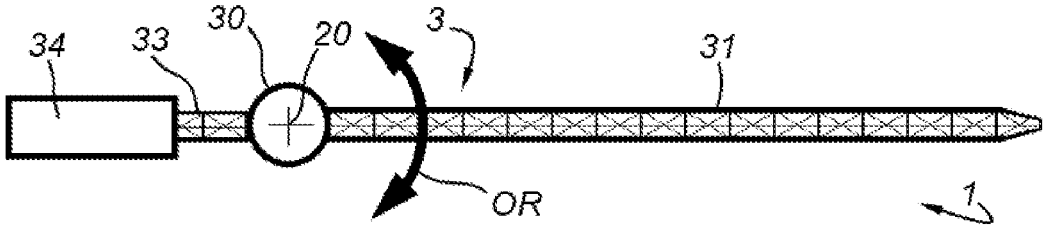
FIG. 2 is a schematic top view of a tower crane according to an embodiment.

Referring to FIG. 1, a tower crane 1 according to embodiments herein comprises a tower 2 (also called a mast) extending along an orientation axis 20 which is vertical, where the tower 2 rests on a ground and has a top on which is pivotally mounted a rotating portion 3 along the orientation axis 20, as diagrammatically shown by the arrow «OR».

This rotating portion 3 comprises an assembly forming a pivot 30 rotary mounted on the top of the tower 2 along the orientation axis 20, as well as an arrow 31 mounted on the assembly forming a pivot 30. A distribution and lifting system load 32 is mounted on the boom 31 to distribute and raise/lower a load along the boom 31. The rotating portion 3 may also comprise a counter-boom 33 mounted on the pivot assembly 30, opposite to the boom 31, and one or more weights 34 can be mounted on a counter-boom 33. The rotating portion 3 further comprises a pilot cabin 35, placed on the assembly forming a pivot 30 at the level of the foot of the boom 31. It is conceivable to have a boom holder 36 or punch which is vertically mounted on the assembly forming a pivot 30, to carry the boom 31, and possibly the counter-boom 33, for example by means of shrouds.

The rotating portion 3 is pivotally mounted by means of a pivot mechanism 4 provided on the pivot assembly 30, where this pivot mechanism 4 includes a motorized orientation system 40 which comprises:

- a fixed pivot intended to be fixedly attached to the top of the tower 2, which is in the form of a toothed orientation ring 41;
- a rotating pivot rotatably coupled to the fixed pivot along the orientation axis 20, which is in the form of an annular bearing resting on the orientation ring 41;
- at least one orientation electric motor 42 provided with a pinion meshing with the orientation ring 41; and
- a variator 43 connected to the orientation electric motor 42 to adjust its speed and torque.

This pivoting mechanism 4 also includes:

- a mechanical orientation brake 44; and
- an angular detector 45 capable of detecting an orientation angle of the rotating portion 3 about the orientation axis 20.

The tower crane 1 also comprises a control/command unit 5 connected:

- to the motorized orientation system 40, and more specifically to the variator 43, in order to drive the orientation of the rotating portion 3;
- to the mechanical orientation brake 44 in order to activate this brake to block/brake the orientation of the rotating portion 3; and
- to the angular detector 45 in order to recover the variations in the orientation angle of the rotating portion 3.

This tower crane 1 is configurable between:

- a service configuration in which the rotating portion 3 can be driven in rotation on the tower 2 along the orientation axis 20 by driving the motorized orientation system 40 by means of the control/command unit 5, and
- an out of service configuration in which the rotating portion 3 is released in rotation on the tower 2 along the orientation axis 20 in order to be able to be oriented in the direction of the wind, the mechanical orientation brake 44 being deactivated and the motorized orientation system 40 being disengaged in the out of service configuration.

When tower crane 1 is in the out of service configuration, the control/command unit 5 activates a monitoring mode in which the control/command unit 5:

- receives, coming from the angular detector 45, the variations in the orientation angle of the rotating portion 3;
- establishes, from the variations in the orientation angle of the rotating portion 3, the variations of an angular speed of the rotating portion 3.

The control/command unit 5 deactivates this monitoring mode when the tower crane 1 is in the service configuration.

Figure 3:
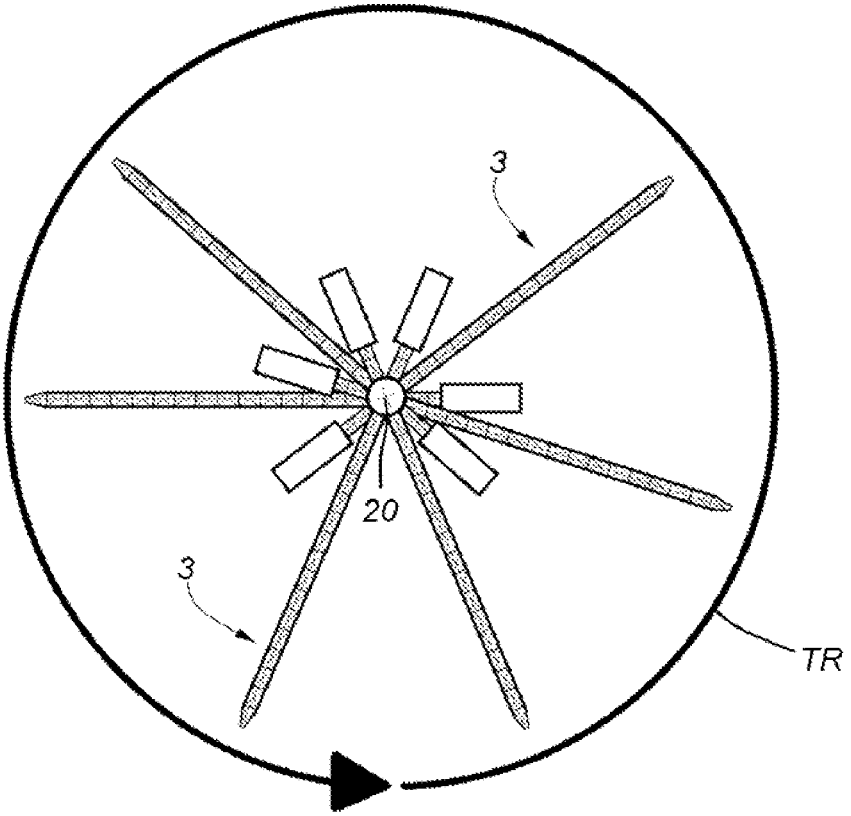
FIG. 3 is a schematic top view of a tower crane in a autorotation state.
Figure 4:
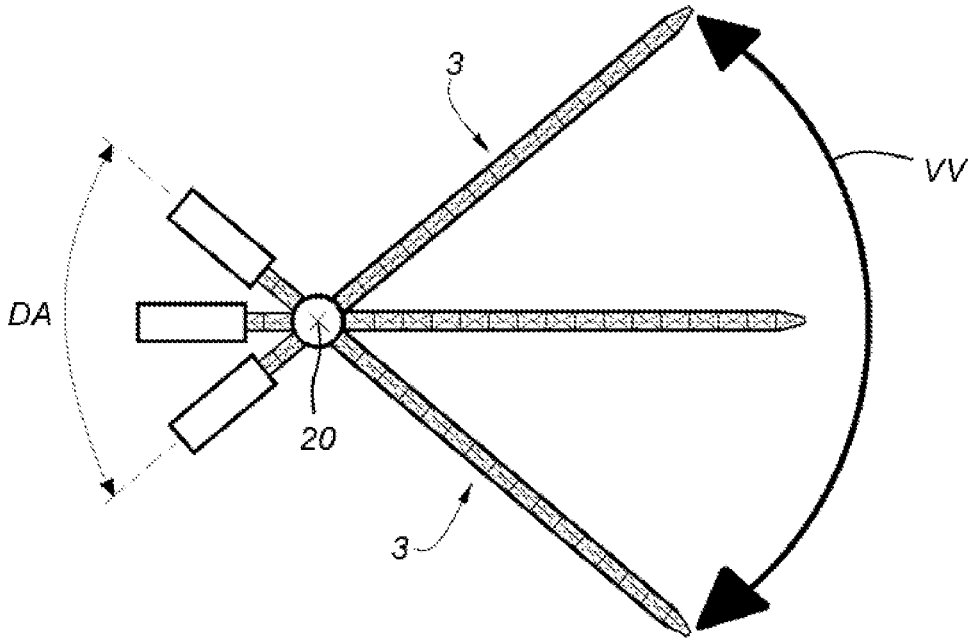
FIG. 4 is a schematic top view of a tower crane in an oscillation state.

In this monitoring mode, the control/command unit 5 detects, as a function of the variations in the orientation angle and/or as a function of the variations in the angular speed, whether the rotating portion is in one of the following movement states:

- an autorotation state, illustrated in FIG. 3, corresponding to a rotary movement of the rotating portion 3 about the orientation axis 20 in a given direction over at least one complete turn, as diagrammatically shown by the arrow «TR»; or
- an oscillation state, illustrated in FIG. 4, corresponding to a back and forth movement of the rotating portion 3 about the orientation axis 20, as diagrammatically shown by the arrow «VV».

The autorotation state is characterized by a variation of the orientation angle according to an angular amplitude at least greater than an angular autorotation threshold SAAR of at least 360 degrees in a first given time interval T1 or at an angular speed greater than a given autorotation speed threshold SVAR.

By way of example, the angular autorotation threshold SAAR is 360 degrees, in other words the autorotation state is detected from a full turn in the first time interval T1 which is in particular at most 10 minutes, and for example in the range of 5 to 10 minutes. In this case, the autorotation state is detected if the rotating portion 3 makes at least one complete turn in less than T1 minutes, and for example in less than 10 minutes if T1 is equal to 10 minutes. Alternatively or in addition, the autorotation speed threshold SVAR can be at least 6 t/h (turns per hour). In this case, the autorotation state is detected if the rotating portion 3 makes at least one complete turn with an angular speed greater than or equal to 6 t/h.

The oscillation state is characterized by at least one cycle of variations of the orientation angle in a first direction then in a second direction, opposite to the first direction (in other words at least one round trip or back and forth cycle), characterized by an angular displacement DA of the orientation angle at least equal to an angular oscillation threshold SAO comprised between 20 and 180 degrees in a second given time interval T2 or at an angular speed greater than a given oscillation speed threshold SVO.

For example, the angular oscillation threshold SAO is 20 degrees, in other words the oscillation state is detected from a back and forth movement according to an angular displacement DA greater than or equal to 20 degrees in the second time interval T2 which is in particular at most 5 minutes, and for example in the range of 2 to 5 minutes. In this case, the oscillation state is detected if the rotating portion 3 moves back and forth with an angular movement of at least 20 degrees in less than T2 minutes, and for example in less than 5 minutes if T2 is equal to 5 minutes. It should be noted that when back and forth according to an angular displacement DA, the rotating portion 3 rotates by DA degrees in one direction and then by DA degrees in the other direction. Alternatively or in addition, the oscillation speed threshold SVO can be at least 1.3 t/h (turns per hour). In this case, the oscillation state is detected if the rotating portion 3 moves back and forth with an angular movement of at least 20 degrees with an angular speed greater than or equal to 1.3 t/h.

Moreover, it is conceivable that the tower crane 1 comprises at least one anemometer 8 suitable for measuring a wind speed and connected to the control/command unit 5. Thus, in the monitoring mode, the control/command unit 5 detects a movement state also as a function of the wind speed, and further, a high movement state as described later.

In the monitoring mode, if a movement state is detected, then the control/command unit 5 records in a memory 50 a movement event defined by recording:

- dating (day and time) of the movement state,
- variations in wind speed or average wind speed or maximum wind speed during the movement state;

and also a recording of one or more movement parameters selected from:

- variations in the angle of orientation;
- angular speeds or at least a maximum angular velocity during the movement state;
- the angular amplitude for an autorotation state;
- the angular displacement DA for an oscillation state.

The tower crane 1 also comprises a wired or wireless transmitter 7, connected to the control/command unit 5, so that the control/command unit 5 triggers a transmission by the transmitter 7 to a third party of a preventive message containing the movement event, with all associated recorded data such as dating, wind speed and movement parameter(s).

In the monitoring mode, the control/command unit 5 also detects whether the movement state corresponds to one of the following high movement states, established regardless of the wind speed:

- an autorotation state in which the angular amplitude is greater than a high angular autorotation threshold SCAAR in the first time interval T1 given, this high angular autorotation threshold SCAAR being greater than the angular autorotation threshold SAAR;
- an autorotation state in which the angular speed is greater than a high autorotation speed threshold SCVAR, this high autorotation speed threshold SCVAR being greater than the autorotation speed threshold SVAR.

In the example above, the angular autorotation threshold SAAR is 360 degrees, and for example the high angular autorotation threshold SCAAR is 720 degrees (namely 2 turns). In this case, the high movement state is detected if the rotating portion 3 makes at least two turns in less than T1 minutes, and for example in less than 10 minutes if T1 is equal to 10 minutes.

In the example above, the autorotation speed threshold SVAR is 6 t/h, and for example the high autorotation speed threshold SCVAR is 12 t/h. In this case, the high movement state is detected if the rotating portion 3 makes at least one complete turn with an angular speed greater than or equal to 12 t/h.

In an advantageous version, the wind speed is taken into consideration to characterize another high movement state, which corresponds to an autorotation state in which the angular speed is comprised between the autorotation speed threshold SVAR and the high autorotation speed threshold SCVAR, and the wind speed is greater than a high wind speed threshold SCVV, which is for example comprised between 10 and 20 m/s, and in particular between 14 and 20 m/s.

In the example above, the autorotation speed threshold SVAR is 6 t/h, and the high autorotation speed threshold SCVAR is 12 t/h. In the example above, the high autorotation speed threshold SCVAR is 9 t/h. In this case, the high movement state is detected if the rotating portion 3 makes at least one complete turn with an angular speed between 6 t/h and 12 t/h, and if (double condition) the wind speed is greater than the high wind speed threshold SCVV which is for example 14 m/s.

When such a high movement state is detected, then the control/command unit 5 triggers at least one alert action, such as for example all or part of the alert actions in the list below:

activation of a sound or light local alarm, the control/command unit 5 being connected to a local alarm generator 7, for example a loudspeaker in the example illustrated in FIG. 1;

transmission of an alarm message to a remote entity, via the transmitter 6;

transmission to a third party of a warning message informing of a detection of a high movement state, via the transmitter 6;

activation of the mechanical orientation brake 44;

activation of the motorized orientation system 40 to generate a braking torque opposed to the rotation of the rotating portion 3.

According to an embodiment, the systems and/or methods herein, such as the method for monitoring a tower crane (1), may be implemented as, include, and/or be performed by one or more computers having a processor and a non-transitory computer-readable storage medium operably connected to the processor. The processor may be a microprocessor. The processor is configured to execute program instructions stored in the computer-readable storage medium to control operations of the crane, or components of the crane, according to the program instructions. In this manner, the methods, steps, operations, processes and the like of the tower crane (1) may be performed by way of one or more computers. In one example, the control/command unit (5) may be implemented as, or include, one or more such computers and/or processors, and may be configured to perform some or all of the methods, steps, operations, processes and the like described herein, including the method for monitoring the tower crane (1).

The invention claimed is:

1. A tower crane comprising:

a tower on which a rotating portion is pivotally mounted along an orientation axis by a pivot mechanism, the pivot mechanism including at least a motorized orientation system, a mechanical orientation brake and an angular detector configured to detect an orientation angle of the rotating portion, wherein the tower crane is configurable between a service configuration in which the rotating portion is rotatably driven on the tower along the orientation axis by the motorized orientation system, and an out of service configuration in which the rotating portion is rotatably released on the tower according to the orientation axis for orientation in a direction corresponding to a wind direction, the mechanical orientation brake being deactivated in the out of service configuration;

a control/command unit connected to the motorized orientation system, the mechanical orientation brake and the angular detector, wherein, in the out of service configuration, the control/command unit activates a monitoring mode in which the control/command unit detects, as a function of variations in the angle of orientation of the rotating portion or as a function of variations of an angular speed of the rotating portion established from the variations of the orientation angle, if the rotating portion is in one of the following movement states:

an autorotation state corresponding to a rotary movement of the rotating portion in a given direction over at least one complete turn, wherein a variation of the orientation angle according to an angular amplitude is at least greater than one angular autorotation threshold of at least 360 degrees in a first given time interval or at an angular speed greater than a given autorotation speed threshold, and an oscillation state corresponding to a back and forth movement of the rotating portion about the orientation axis, wherein at least one cycle of variations of the angle of orientation includes movement of the rotating portion in a first direction then in a second direction, opposite to the first direction, and wherein an angular displacement of the orientation angle is at least equal to an angular oscillation threshold comprised between 20 and 180 degrees in a given second time interval or at an angular speed greater than a given oscillation speed threshold.

2. The tower crane according to claim 1, wherein, in the service configuration, the control/command unit deactivates the monitoring mode.

3. The tower crane according to claim 1, comprising at least one anemometer for measuring a wind speed, the anemometer connected to the control/command unit, and in which, in the monitoring mode, the control/command unit detects a movement state also depending on the wind speed.

4. The tower crane according to claim 3, wherein, in the monitoring mode, if a movement state is detected, then the control/command unit records a movement event defined by a recording of a dating of the movement state and of one or more movement parameters chosen from: variations in the angle of orientation, angular speeds or at least a maximum angular speed during the movement state, the angular amplitude for the autorotation state, and the angular displacement for the oscillation state, and wherein, in the monitoring mode, if a movement state is detected, then the control/command unit registers in the movement event also changes in wind speed or average wind speed or maximum wind speed during the movement state.

5. The tower crane according to claim 3, wherein, in the monitoring mode, the control/command unit detects whether the movement state corresponds to one of the following high movement states:

an autorotation state in which the angular amplitude is greater than a high angular autorotation threshold in the first given time interval, the high angular autorotation threshold being greater than the angular autorotation threshold; and an autorotation state in which the angular speed is greater than a high autorotation speed threshold, the high autorotation speed threshold being greater than the autorotation speed threshold, wherein when one of the high movement states is detected, then the control/command unit triggers at least one alert action, and wherein another high movement state corresponds to an autorotation state in which the angular speed is between the autorotation speed threshold and the high autorotation speed threshold, and the wind speed is above a high wind speed threshold.

6. The tower crane according to claim 5, wherein the high wind speed threshold is between 10 and 20 m/s.

7. The tower crane according to claim 6, wherein the high wind speed threshold is between 14 and 20 m/s.

8. The tower crane according to claim 1, wherein, in the monitoring mode, if a movement state is detected, then the control/command unit records a movement event defined by a recording of a dating of the movement state and of one or more movement parameters chosen from:

variations in the angle of orientation;

angular speeds or at least a maximum angular speed during the movement state;

the angular amplitude for the autorotation state; and the angular displacement for the oscillation state.

9. The tower crane according to claim 8, wherein the control/command unit triggers a transmission to a third party of a preventive message containing the movement event.

10. The tower crane according to claim 1, wherein, in the monitoring mode, the control/command unit detects whether the movement state corresponds to one of the following high movement states:

an autorotation state in which the angular amplitude is greater than a high angular autorotation threshold in the first given time interval, the high angular autorotation threshold being greater than the angular autorotation threshold; and an autorotation state in which the angular speed is greater than a high autorotation speed threshold, the high autorotation speed threshold being greater than the autorotation speed threshold, wherein, when such a high movement state is detected, then the control/command unit triggers at least one alert action.

11. The tower crane according to claim 10, wherein the alert action comprises an activation of a sound or light local alarm.

12. The tower crane according to claim 10, wherein the alert action comprises transmitting an alarm message to a remote entity.

13. The tower crane according to claim 10, wherein the alert action comprises a transmission to a third party of a warning message informing of a detection of a critical instability state.

14. The tower crane according to claim 10, wherein the alert action comprises activating the mechanical orientation brake.

15. The tower crane according to claim 10, wherein the alert action comprises an activation of the motorized orientation system to generate a braking torque opposite to the rotation of the rotating portion.

16. A method for monitoring a tower crane comprising a tower on which a rotating portion is pivotally mounted along an orientation axis by of a pivot mechanism, the pivot mechanism including at least a motorized orientation system, a mechanical orientation brake and an angular detector configured to detect an orientation angle of the rotating portion, wherein the tower crane is configurable between a service configuration in which the rotating portion is rotatably driven on the tower along the orientation axis by the motorized orientation system, and an out of service configuration in which the rotating portion is rotatably released on the tower along the orientation axis for orientation in a direction corresponding to a wind direction, the mechanical orientation brake being deactivated in the out of service configuration, wherein the tower crane further comprises a control/command unit connected to the motorized orientation system and to the angular detector, the monitoring method comprising:

in the out of service configuration, activating a monitoring mode in which the control/command unit detects, as a function of variations in the angle of orientation of the rotating portion or as a function of variations of an angular speed of the rotating portion established from the variations in the orientation angle, if the rotating portion is in one of the following movement states:

in an autorotation state, corresponding to a rotary movement of the rotating portion in a given direction over at least one complete turn, wherein a variation of the orientation angle according to an angular amplitude is at least greater than an angular autorotation threshold of at least 360 degrees in a first given time interval or at an angular speed greater than a given autorotation speed threshold, and in an oscillation state, corresponding to a back and forth movement of the rotating portion about the orientation axis, wherein at least one cycle of variations of the angle of orientation includes movement of the rotating portion in a first direction then in a second direction, opposite to the first direction, and wherein an angular displacement of the orientation angle is at least equal to an angular oscillation threshold comprised between 20 and 180 degrees in a second interval of given time or at an angular speed greater than a given oscillation speed threshold.

17. The monitoring method according to claim 16, comprising, in the service configuration, deactivating the monitoring mode.

* * * * *